United States Patent [19]

Fujiwara et al.

[11] Patent Number: 4,708,773

[45] Date of Patent: Nov. 24, 1987

[54] IMPERMEABLE PLATE FOR UNIFORMLY DISPERSING PAPER RAW MATERIAL IN A TWIN WIRE PAPER FORMER

[75] Inventors: Haruyoshi Fujiwara, Hiroshima; Tetsuo Makino, Mihara; Hiroshi Iwata, Hiroshima, all of Japan

[73] Assignee: Mitsubishi Jukogyo Kabushiki Kaisha, Tokyo, Japan

[21] Appl. No.: 772,675

[22] Filed: Sep. 5, 1985

[30] Foreign Application Priority Data

Sep. 12, 1984 [JP] Japan ..... 59-189751

[51] Int. Cl.[4] ..... D21F 1/36; D21F 1/00

[52] U.S. Cl. ..... 162/300; 162/301; 162/351

[58] Field of Search ..... 162/300, 301, 303, 308, 162/297, 358, 211, 351

[56] References Cited

U.S. PATENT DOCUMENTS

| | | | |
|---|---|---|---|
| 2,821,120 | 1/1958 | Thomas et al. | 162/300 |
| 3,201,305 | 8/1965 | Webster | 162/303 |
| 3,797,384 | 3/1974 | Hoff | 162/360.1 |
| 3,810,818 | 5/1974 | Arledter | 162/303 |
| 4,417,950 | 11/1983 | Bubik et al. | 162/300 |
| 4,491,521 | 1/1985 | Wenske | 162/300 |

FOREIGN PATENT DOCUMENTS

| | | | |
|---|---|---|---|
| 53-2608 | 1/1978 | Japan | 162/300 |
| 8000460 | 3/1980 | PCT Int'l Appl. | 162/60 |

*Primary Examiner*—S. Leon Bashore
*Assistant Examiner*—K. M. Hastings
*Attorney, Agent, or Firm*—Wenderoth, Lind & Ponack

[57] ABSTRACT

A novel apparatus for uniformly dispersing paper raw material in a paper making machine, in which a dewatering limit member impermeable to water is provided for covering two wires travelling along a curved surface of a wire support and for providing an adjustable urging force against the support, and thereby a dewatering limit region is defined such that the interval between the support and the dewatering limit member is decreased and then increased in a wedge-like manner along the direction of travelling of the wires.

2 Claims, 12 Drawing Figures

IMPERMEABLE PLATE FOR UNIFORMLY DISPERSING PAPER RAW MATERIAL IN A TWIN WIRE PAPER FORMER

BACKGROUND OF THE INVENTION

1. Field of the Invention

The present invention relates to an apparatus for uniformly dispersing paper raw material that can be utilized in various twin wire formers of a paper making machine.

2. Description of the Prior Art

One known wire former making use of two wires which provide excellent fiber dispersion in paper is a Bel-Baie former (vertical type gap former) manufactured by Beloit Corp. of Beloit, Wis. shown in FIG. 11. However, this former has a shortcoming in that a yield retention is poor. More particularly, in this former, after a raw material liquid has been sandwiched between two wires consisting of an upper wire a and a lower wire b, if dewatering is carried out while rubbing the wires with a fixed member (shoe blades c, suction boxes d, vacuum deflector e and suction couch roll f), then white water having a high concentration will flow out of the wires.

In order to obviate this shortcoming, it is only necessary to reduce the fixed members which perform dewatering by rubbing the wire surface and to carry out dewatering by means of members which travel along with the wires, such as rolls. A Bel-Baie former constructed in such a manner is shown in FIG. 12.

Normally in a Bel-Baie former, the former is operated in such manner that a water level is located above the suction box d. However, if the fixed dewatering devices are reduced by decreasing the numbers of the shoe blades c and the suction boxes d as compared to the arrangement shown in FIG. 11 and also by omitting the vacuum deflector, the water level is located at a position on the suction couch roll f as shown in FIG. 12. The retention is improved, but the fiber dispersion tends to be degraded.

It was previously discovered through research conducted by the inventors of this invention that the fiber dispersion in a twin wire former can be greatly improved by decelerating and accelerating in the direction of travel, a raw material liquid without stirring the raw material liquid by applying a pressure gradient to the raw material liquid at the portion of sandwiching the raw material is sandwiched between two wires or after at a portion before which the raw material liquid has been sandwiched.

An appropriate value of this pressure gradient for carrying out deceleration and acceleration will vary depending upon a paper making speed, a weight of paper per unit area, compounding of the raw material, a concentration under the given state and the like. In the known twin wire former in the prior art, improvements in the fiber dispersion were achieved by applying a pressure variation to the raw material liquid by means of shoes, a foil, a roll suction box, etc., but it was almost impossible to adjust the pressure variation to an appropriate value according to the paper making condition.

SUMMARY OF THE INVENTION

It is therefore one object of the present invention to provide an apparatus for uniformly dispersing paper raw material, in which the problems in the prior art such as lowering of the fiber dispersion can be resolved and thus the fiber dispersion is improved.

According to one feature of the present invention, there is provided an apparatus for uniformly dispersing paper raw material, in which a dewatering limit member having a generally flat portion not permeable for water is provided so as to cover two wires travelling along a curved surface of a wire support and so as to exert an adjustable urging force on the wires against the support, and thereby a dewatering limit region is defined such that the interval between the support and the dewatering limit member may be decreased and then increased in a wedge-like manner along the direction of travel of the wires.

Due to the above-mentioned structural feature, according to the present invention, when the two wires with paper raw material sandwiched therebetween are passed through the dewatering limit region, a hydraulic pressure varying along the travel direction of the wires is applied to the raw material liquid between the wires, thereby the raw material liquid is decelerated and accelerated in the direction of travel of the wires, and as a result, the raw material liquid can be uniformly dispersed.

The above-mentioned and other objects, features and advantages of the present invention will become more apparent by reference to the following description of preferred embodiments of the invention taken in conjucntion with the accompaying drawings.

DESCRIPTION OF PREFERRED EMBODIMENTS

Figure 1:
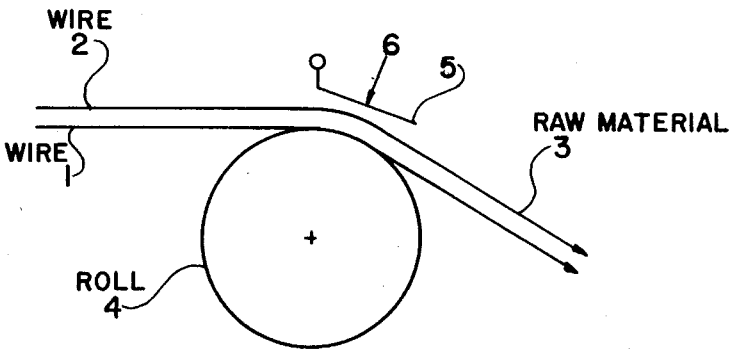
FIG. 1 is a cross-sectional side view of an apparatus for uniformly dispersing paper raw material according to one preferred embodiment of the present invention.

Now, description will be made of the preferred embodiments of the present invention illustrated in FIGS. 1 to 10. At first, referring to FIG. 1, a first wire 1 and a second wire 2 are travelling around a roll 4 with paper making raw material 3 sandwiched therebetween. The roll 4 could be any one of an open roll, a suction roll and a plane roll. On the outside of the surface region of the roll 4 supporting the wires 1 and 2, there is provided a plate-like member 5 impermeable to water, and this plate-like member 5 is urged against the roll 4 by means of a pressing device 6 so that the interval between the roll 4 and the plate-like member 5 may be reduced to a wedge-like shape along the direction of travel of the wires 1 and 2. After the wires 1 and 2 have passed the minimum interval portion, the interval between the roll 4 and the plate-like member 5 may be increased again.

Figure 2:
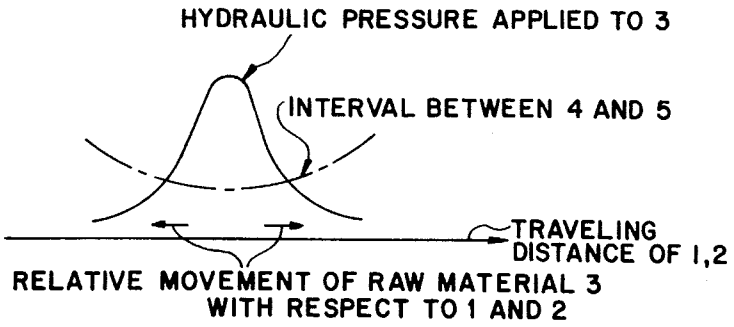
FIG. 2 is a diagram showing the relation of an interval between a roll and a plate-shaped member in FIG. 1 versus a hydraulic pressure applied to a raw material liquid.
Figure 3:
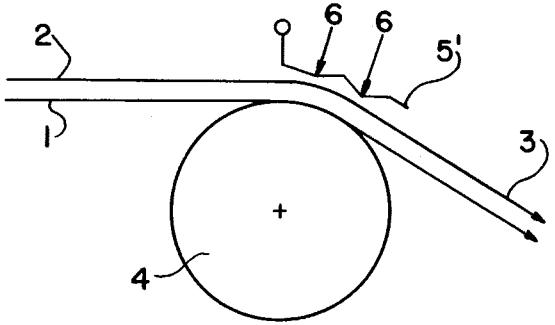
FIGS. 3, 4, 5 and 6, respectively, are cross-section side views showing apparatuses for uniformly dispersing paper raw material according to other embodiments of the present invention.
Figure 4:
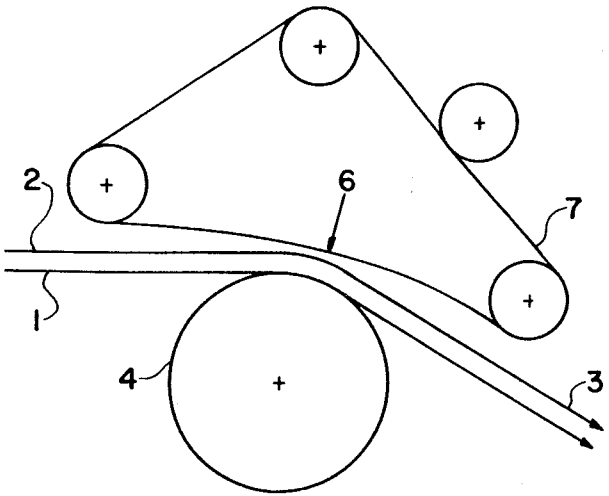
Figure 7:
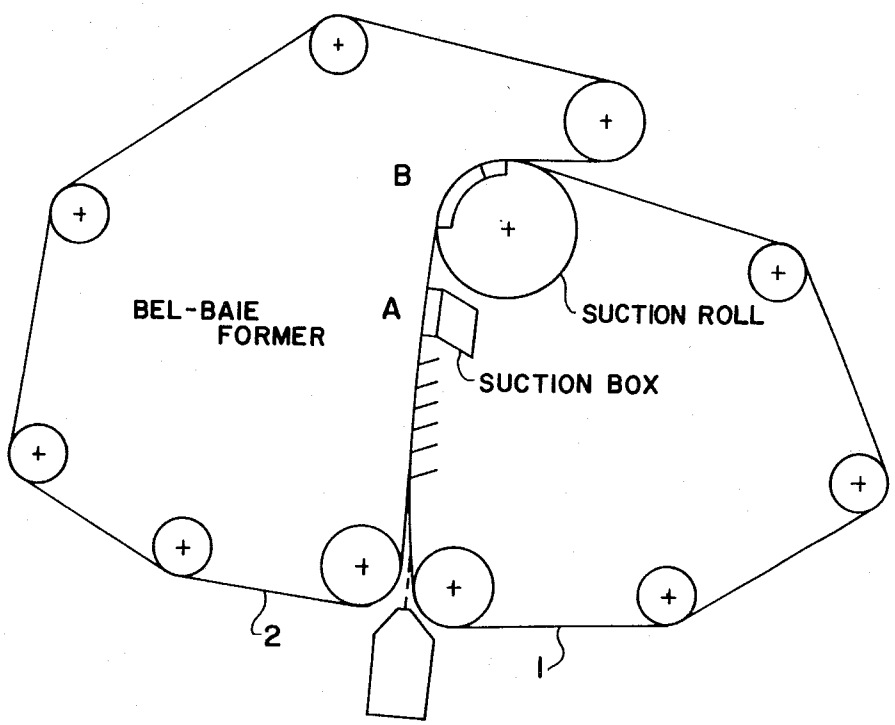
FIGS. 7, 8, 9 and 10, respectively, are side views showing the portions of various twin wire formers, to which the present invention is applicable.

Describing now the operation of the preferred embodiment constructed in the above-described manner, FIG. 2 shows variation of a hydraulic pressure applied to the raw material 3 as it travels jointly with the wires 1 and 2 as well as a mode of deceleration and acceleration of the raw material 3 relative to the wires 1 and 2 caused by the variation of the hydraulic pressure. The travelling distance of the wires 1 and 2 is represented along the abscissa, and an interval between the roll 4 and the plate-like member 5 as well as the aforementioned hydraulic pressure is represented along the ordinate. In this way, if the raw material 3 is subjected to deceleration and acceleration in the direction of travel to an appropriate extent, then fibers and other solid components in the raw material 3 can be dispersed uniformly.

In the case of the system shown in FIG. 1, when the raw material 3 sandwiched between the wires 1 and 2 has come to the position close to the support roll 4, it is urged against the roll 4 by the tension in the wire 2, and so, dewatering would occur. Hence, the contact surfaces between the wire 2 and the plate-like member 5 are always lubricated by white water extracted from the raw material 3, and the wire 2 and the plate-like member 5 would not be brought into direct contact with each other. Accordingly, damage occuring to the wire 2 and the plate-like member 5 is very little, and also, since the wire 2 is not directly rubbed, lowering of retention would not occur.

According to experiments conducted by the inventors of this invention, it was proved that a hydraulic pressure appropriate for improvement of fiber dispersion is high when a paper making speed is high. In the case where the concentration of the sandwiched raw material is high or in the case of tough raw material containing a lot of long fibers also, a good result is obtained by raising the hydraulic pressure, and that in the case where a weight of the raw material per unit area is small also, the effect of improving fiber dispersion is enhanced by raising the hydraulic pressure. However, in any case, if the hydraulic pressure is too large, fine granular fiber dispersion having goose flesh skin-like appearance results, and if a further large hydraulic pressure is applied, marks like a beach at ebb tide are produced.

On the other hand, in the case where the hydraulic pressure is too low, improvement of fiber dispersion is insufficient, and so, it is necessary to adjust the hydraulic pressure shown in FIG. 2 by varying the urging force produced by the pressing device 6, the interval between the roll 4 and the plate-like member 5, or the configuration of the plate-like member 5. In addition, the effect of the wedge-like pressure variation is more effective when it is applied repeatedly than when it is applied once. Hence, the plate-like member 5 could be preliminarily shaped into a corrugated form as shown at 5' in FIG. 3.

Figure 5:
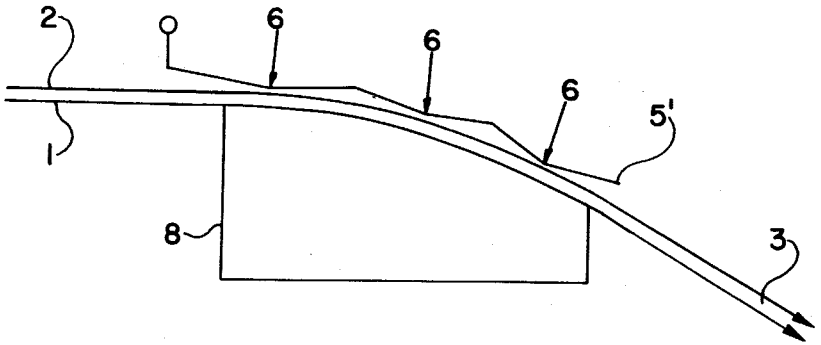
Figure 6:
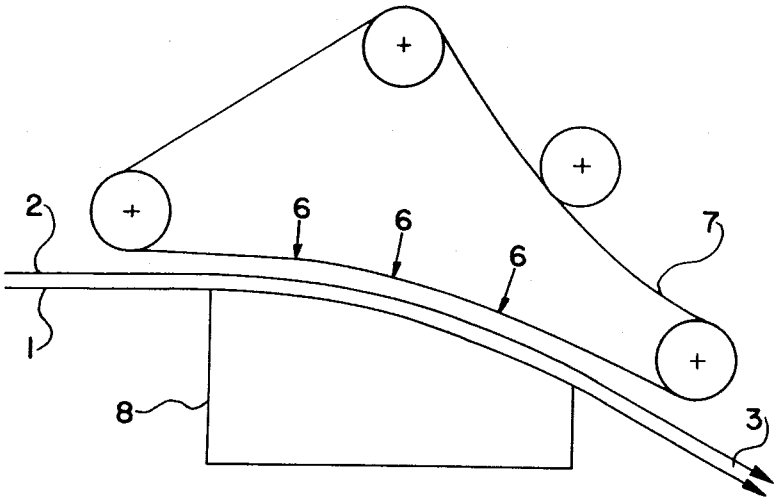
Figure 9:
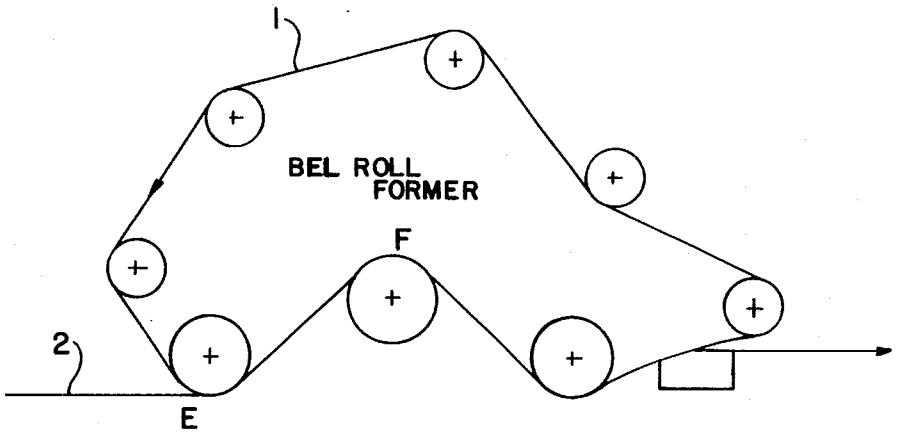
Figure 10:
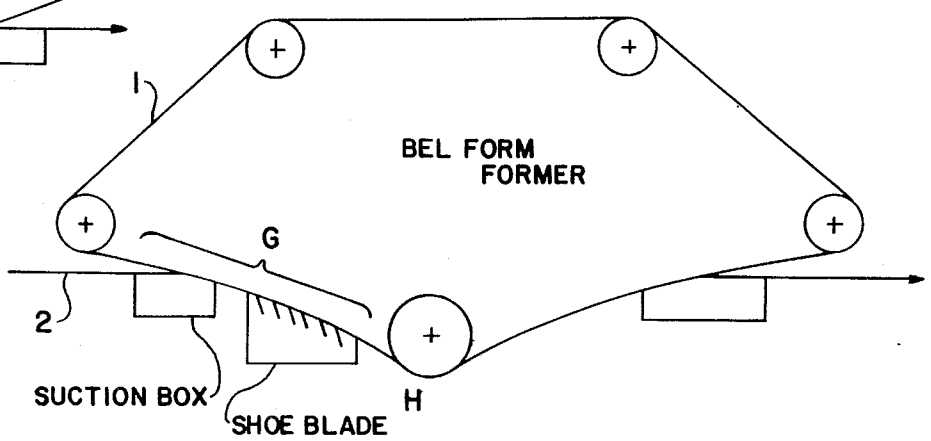
Figure 8:
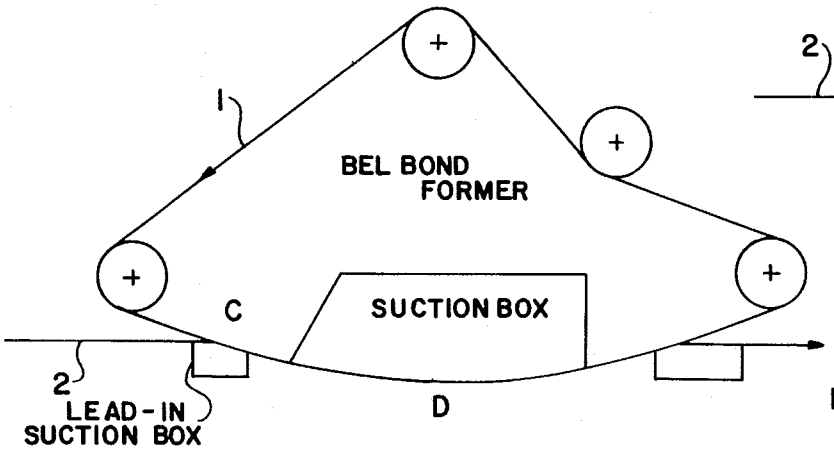
Figure 12:
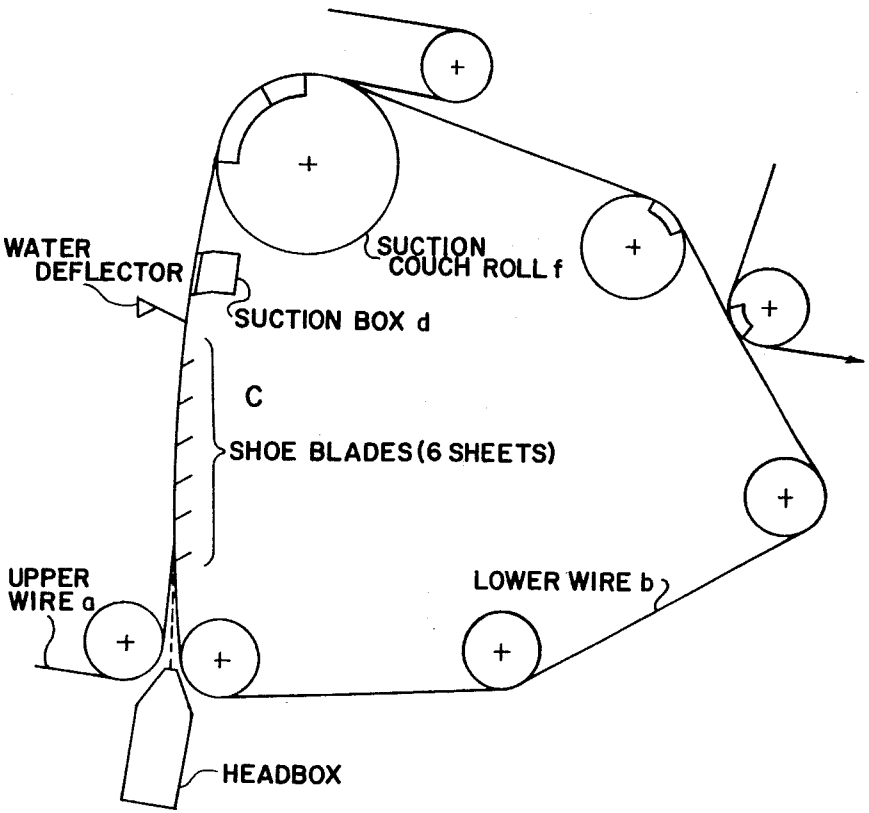
FIG. 12 PRIOR ART
FIGS. 11 and 12, respectively, are side views showing Bel-Baie formers in the prior art.
Figure 11:
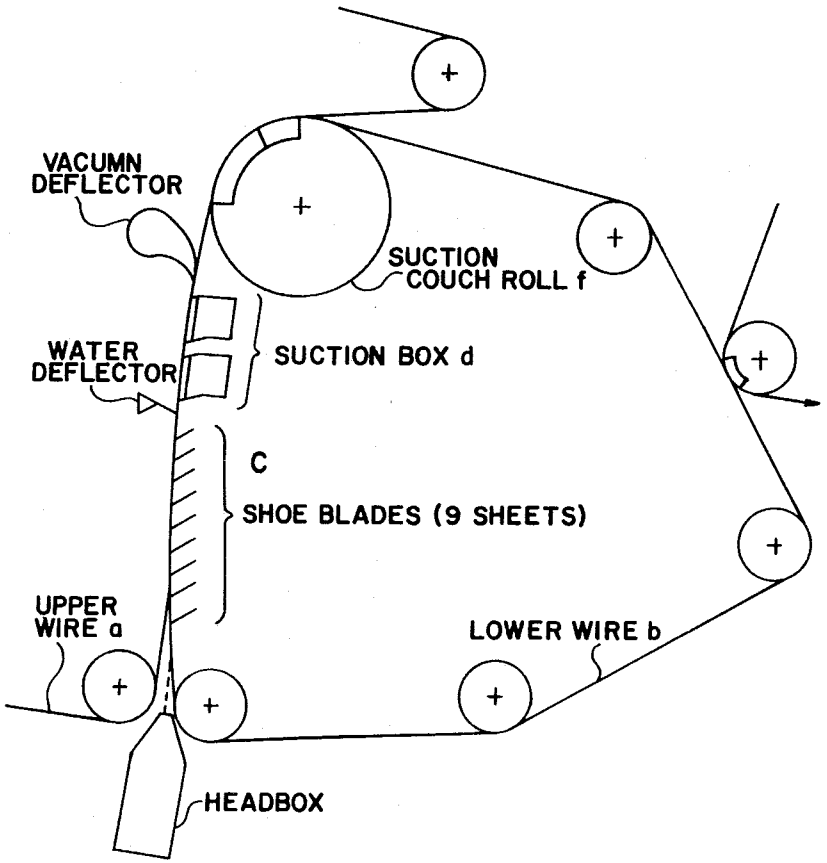
FIG. 11 PRIOR ART

Moreover, since it is only necessary to apply the hydraulic pressure variation as shown in FIG. 2 to the raw material 3, the plate-like member 5 could be replaced by a belt 7 that is impermeable to water which has a generally flat run travelling along with the wires 1 and 2 (FIG. 4) between guide rollers, and further, a member for supporting the wires 1 and 2 could be a fixed member 8 which does not travel along with the wires 1 and 2 such as, for instance, a solid shoe, a foil box, a suction box, etc. (FIGS. 5 and 6).

It is to be noted that the above-described apparatus for improving fiber dispersion can be utilized in various twin wire formers. By way of example, the locations designated by reference characters A, B, C, D, E, F, G and H in FIGS. 7 through 10 are places where the apparatus for improving fiber dispersion can be utilized. However, the present invention should not be limited to only the illustrated examples.

Since the apparatus according to the present invention is constructed as described in detail above, the pressure applied to the raw material liquid can be varied by changing the size and shape of the wedge-like portions so as to always maintain an appropriate value of the hydraulic pressure. In addition, it is to be noted that even if the wedge-like portion for applying a pressure variation to the raw material liquid has such a configuration in that it rubs the wire, in practice, white water flowing out of the wire comes into contact with a fixed member in the wedge-like portion, and the fixed member does not come into contact with the wire. Also, since the wedge-like portion serves to suppress dewatering, white water having a high concentration would not flow out of the wire, and hence, lowering of retention would not occur.

While the present invention has been described above in connection to preferred embodiments of the invention, as a matter of course, it is intended that the present invention should not be limited to the illustrated embodiments but many changes and modifications in design could be made to the illustrated construction without departing from the spirit of the present invention.

What is claimed is:

1. An apparatus for dewatering and uniformly dispersing raw paper material processed in combination with a twin-wire paper former, the paper former comprising a first wire traveling along a first closed looped path over a guide means located in a dewatering zone and a second coacting wire traveling along a second closed-looped path and coacting with and substantially parallel to said first wire in the dewatering zone, the raw paper material traveling between the first and the second coacting wires in the dewatering zone, said apparatus comprising:

a dewatering limit member having a generally flat portion impermeable to water being adjustably positioned over the guide means located in the dewatering zone and between which the first wire, the second wire and the raw paper material traveling between the first and second wires extend, said generally flat portion comprising a plate; and urging means for urging said flat portion of said adjustably positioned dewatering limit member toward and away from the guide means into and out of contact with the second wire for pressing the second wire, the raw paper material and the first wire between said substantially flat portion and the guide means to exert a pressure gradient on the raw paper material while the raw paper material travels between the first and the second wires in the dewatering zone for dewatering and uniformly dispersing the raw paper material in the dewatering zone, said urging means comprising a pressing device for moving said plate into and out of contact with the second wire to press the second wire, the raw paper material and the first wire between said plate and the guide means in a wedge-like manner to exert said pressure gradient on said raw paper material while the raw paper material travels between the first and the second wires in the dewatering zone.

2. An apparatus as claimed in claim 1, wherein said plate is corrugated for providing a plurality of separate spaced apart contact portions which contact the second wire when said corrugated plate is moved towards the guide means by said urging means.

* * * * *